US010820663B2

(12) United States Patent
Walker

(10) Patent No.: US 10,820,663 B2
(45) Date of Patent: Nov. 3, 2020

(54) SHOE SIZING ASSEMBLY

(71) Applicant: Shawn Walker, Stone Mountain, GA (US)

(72) Inventor: Shawn Walker, Stone Mountain, GA (US)

( * ) Notice: Subject to any disclaimer, the term of this patent is extended or adjusted under 35 U.S.C. 154(b) by 233 days.

(21) Appl. No.: 16/155,501

(22) Filed: Oct. 9, 2018

(65) Prior Publication Data

US 2020/0107614 A1 Apr. 9, 2020

(51) Int. Cl.

*A43D 1/02* (2006.01)
*A43D 25/06* (2006.01)
*A43D 25/20* (2006.01)

(52) U.S. Cl.

CPC ..... *A43D 1/02* (2013.01); *A43D 25/06* (2013.01); *A43D 25/20* (2013.01)

(58) Field of Classification Search

CPC ..... A43D 1/02; A43D 25/06
USPC ..... 33/3 A, 3 R, 6, 515
See application file for complete search history.

(56) References Cited

U.S. PATENT DOCUMENTS 4,060,869 A 12/1977 Brown
4,745,290 A 5/1988 Frankel
4,819,644 A * 4/1989 Cherniak ..... A61F 5/019 33/5
5,128,880 A 7/1992 White
6,293,026 B1 * 9/2001 Lee ..... A43B 7/28 33/512
D577,478 S 9/2008 Peveto
7,992,243 B2 9/2011 Cook
8,463,657 B1 6/2013 Bentvelzen
2005/0071242 A1 3/2005 Allen
2007/0163147 A1 * 7/2007 Cavanagh ..... A61B 5/6807 36/44
2012/0174423 A1 * 7/2012 Yang ..... A43D 1/02 33/512
2014/0096403 A1 * 4/2014 Regan ..... A43D 8/00 33/6
2015/0059214 A1 * 3/2015 Donovan ..... A43B 5/06 36/100
2020/0202406 A1 * 6/2020 Luh ..... A61B 5/6807

* cited by examiner

*Primary Examiner* — George B Bennett

(57) ABSTRACT

A shoe sizing assembly for measuring and constructing custom shoe sizes includes a panel that is positionable on a support surface for having a person's foot placed thereon. A scanner is coupled to the panel and the scanner emits a measuring signal upwardly from the panel thereby facilitating the scanner to detect the sole of person's foot. In this way the scanner measures the size of the person's foot. A heating element is coupled to the panel and the heating element heats the panel when the heating element is turned. Thus, the heating element melts an adhesive between the shoe sole and the shoe upper for bonding the shoe sole to the shoe upper.

6 Claims, 5 Drawing Sheets

SHOE SIZING ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art including information disclosed under 37 CFR 1.97 and 1.98

The disclosure and prior art relates to sizing devices and more particularly pertains to a new sizing device for measuring and constructing custom shoe sizes.

BRIEF SUMMARY OF THE INVENTION

An embodiment of the disclosure meets the needs presented above by generally comprising a panel that is positionable on a support surface for having a person's foot placed thereon. A scanner is coupled to the panel and the scanner emits a measuring signal upwardly from the panel thereby facilitating the scanner to detect the sole of person's foot. In this way the scanner measures the size of the person's foot. A heating element is coupled to the panel and the heating element heats the panel when the heating element is turned. Thus, the heating element melts an adhesive between the shoe sole and the shoe upper for bonding the shoe sole to the shoe upper.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
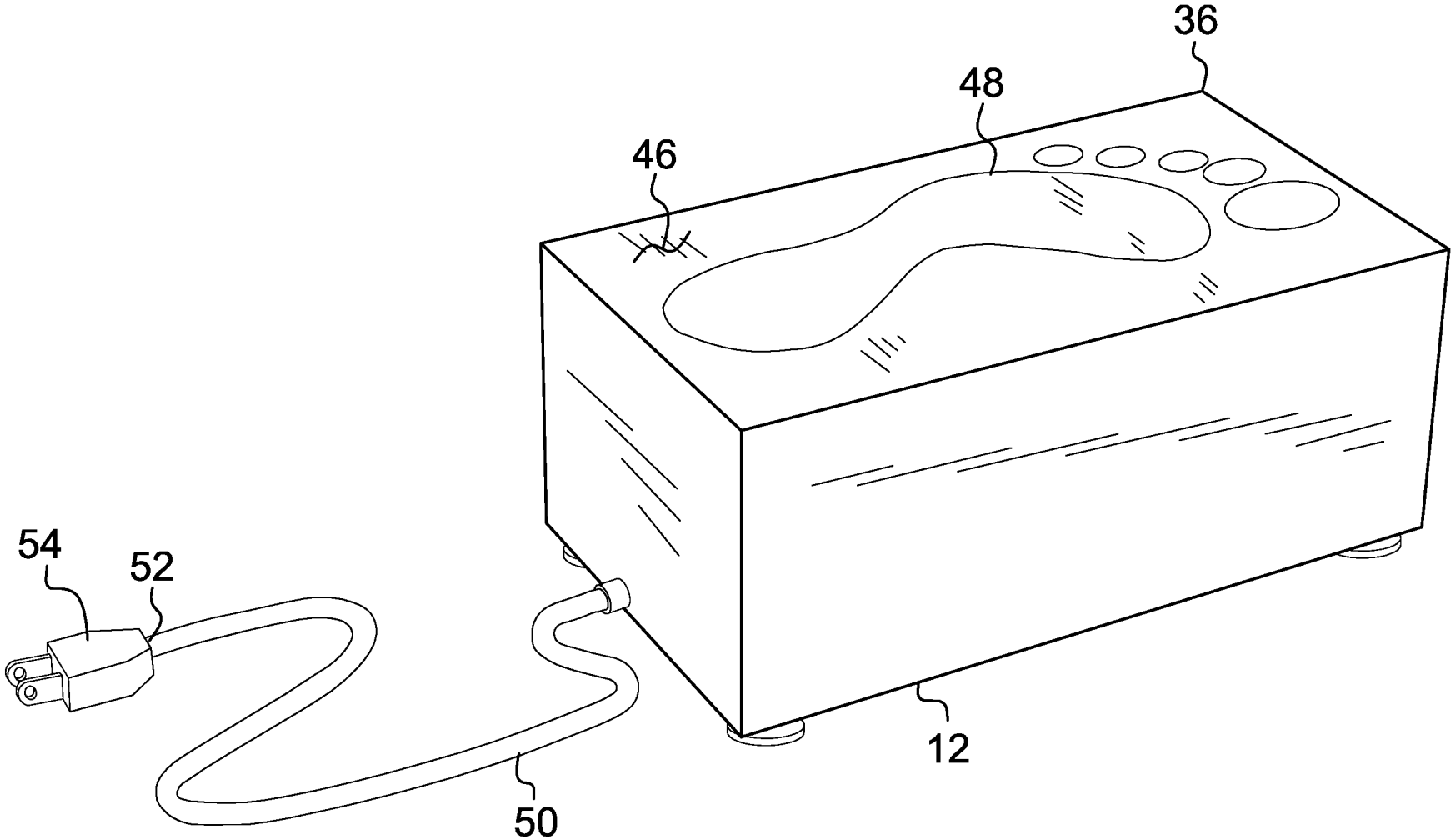
FIG. 1 is a perspective view of a shoe sizing assembly according to an embodiment of the disclosure.
Figure 2:
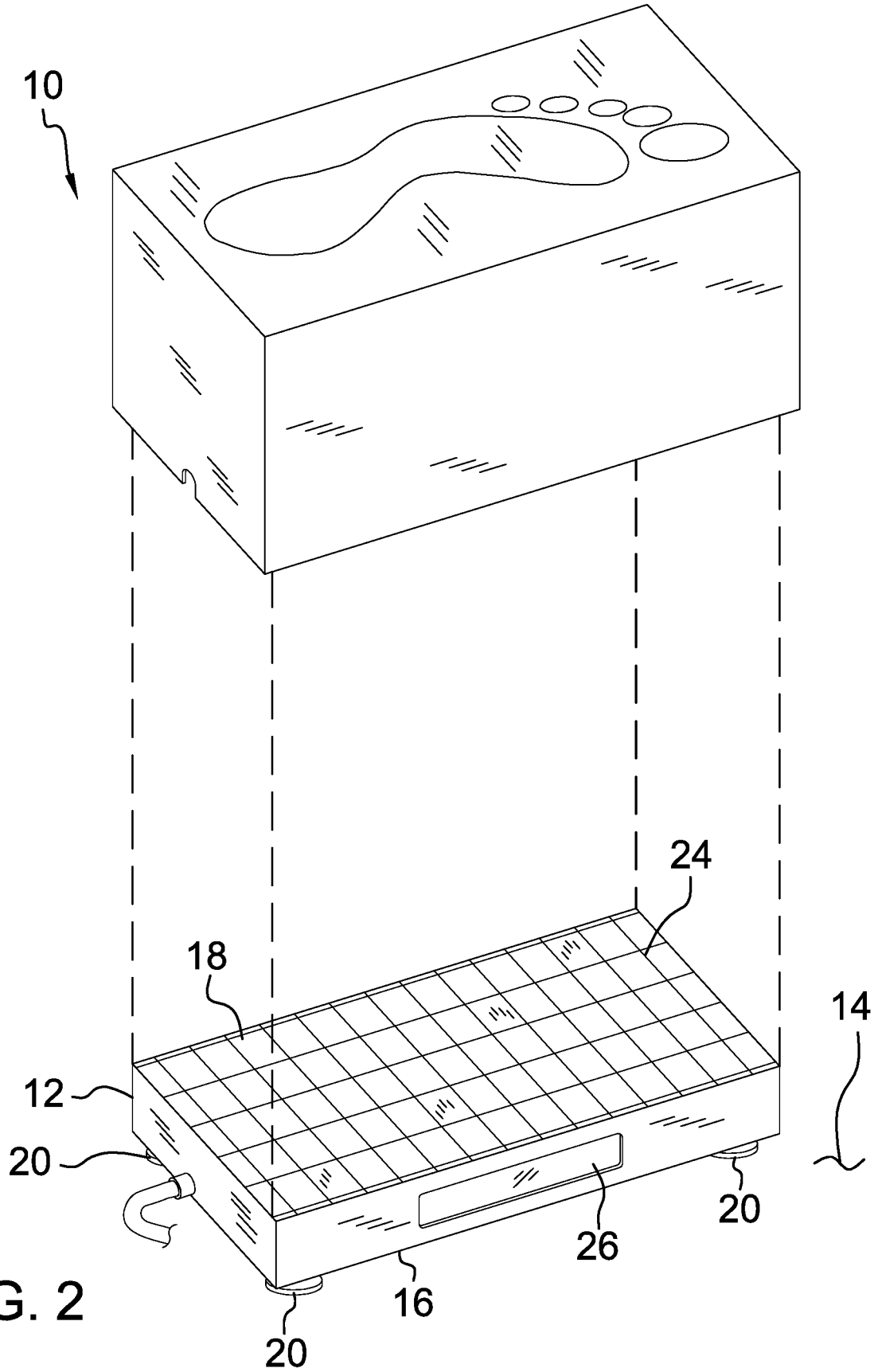
FIG. 2 is an exploded perspective view of an embodiment of the disclosure.
Figure 3:
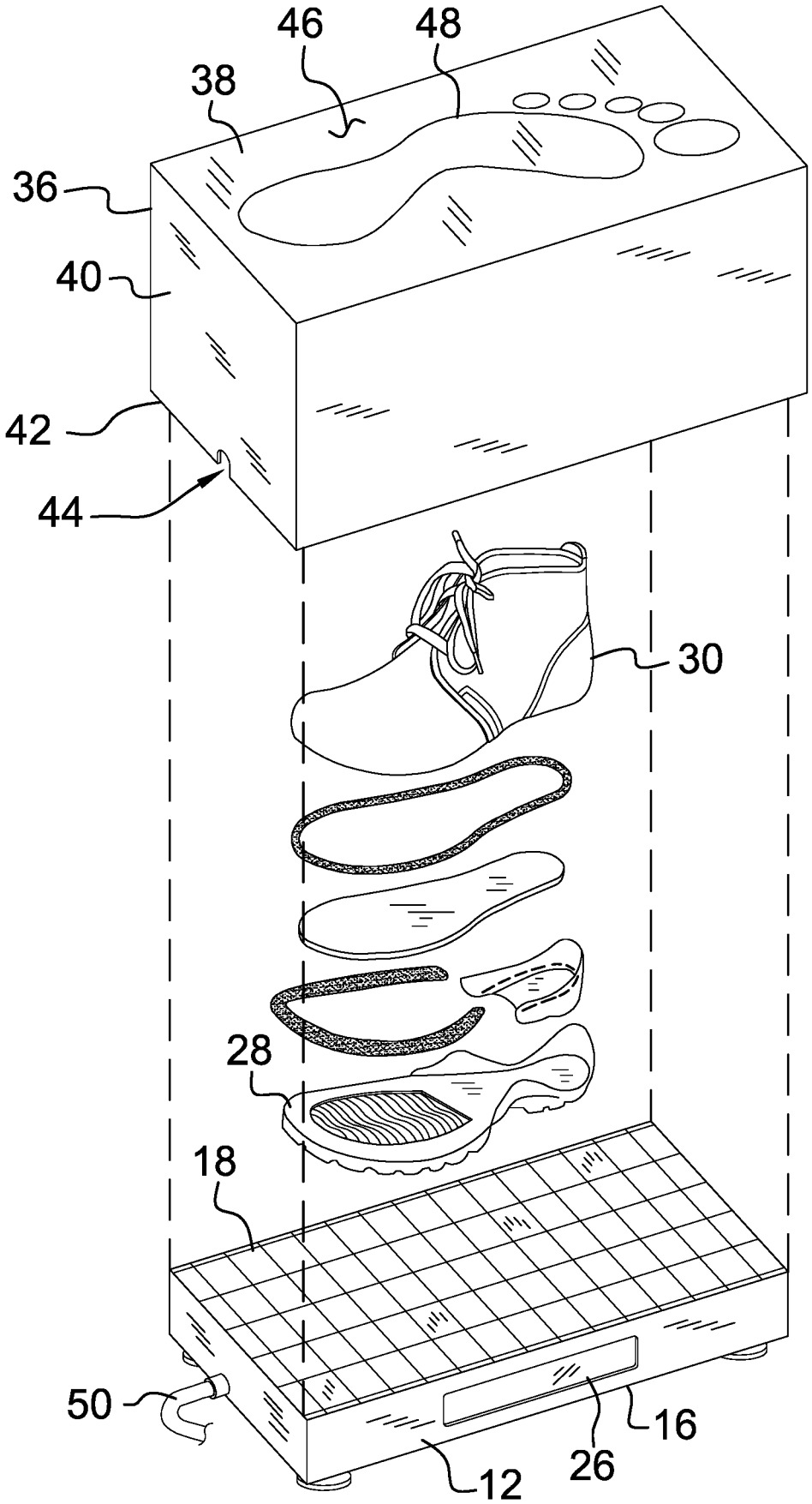
FIG. 3 is an exploded perspective view of an embodiment of the disclosure showing a shoe sole and a shoe upper.
Figure 4:
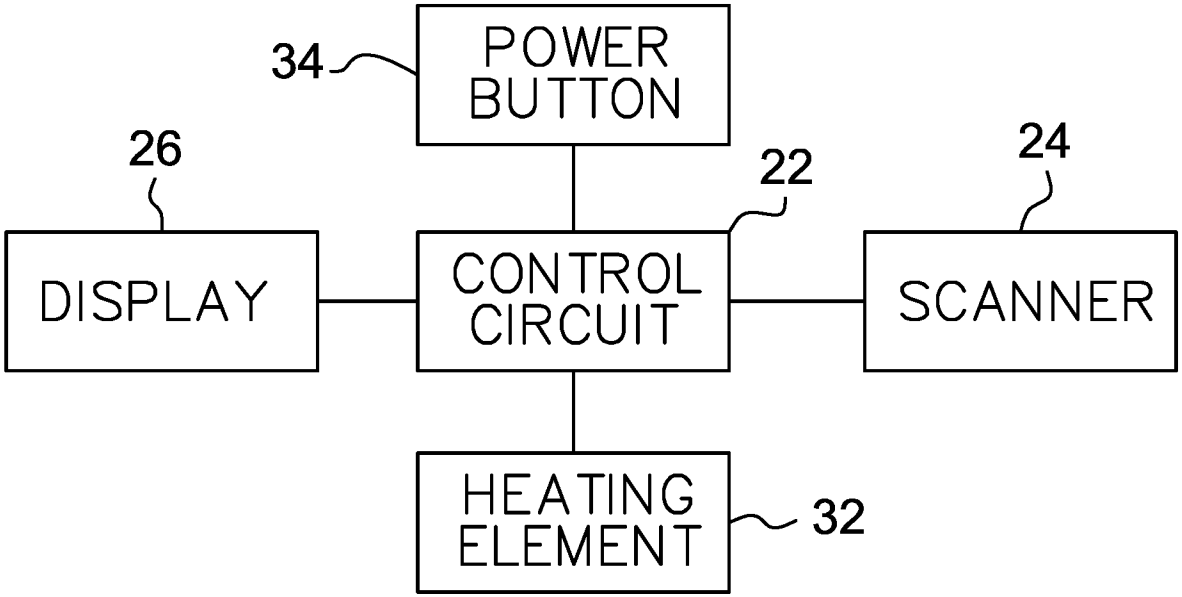
FIG. 4 is a schematic view of an embodiment of the disclosure.
Figure 5:
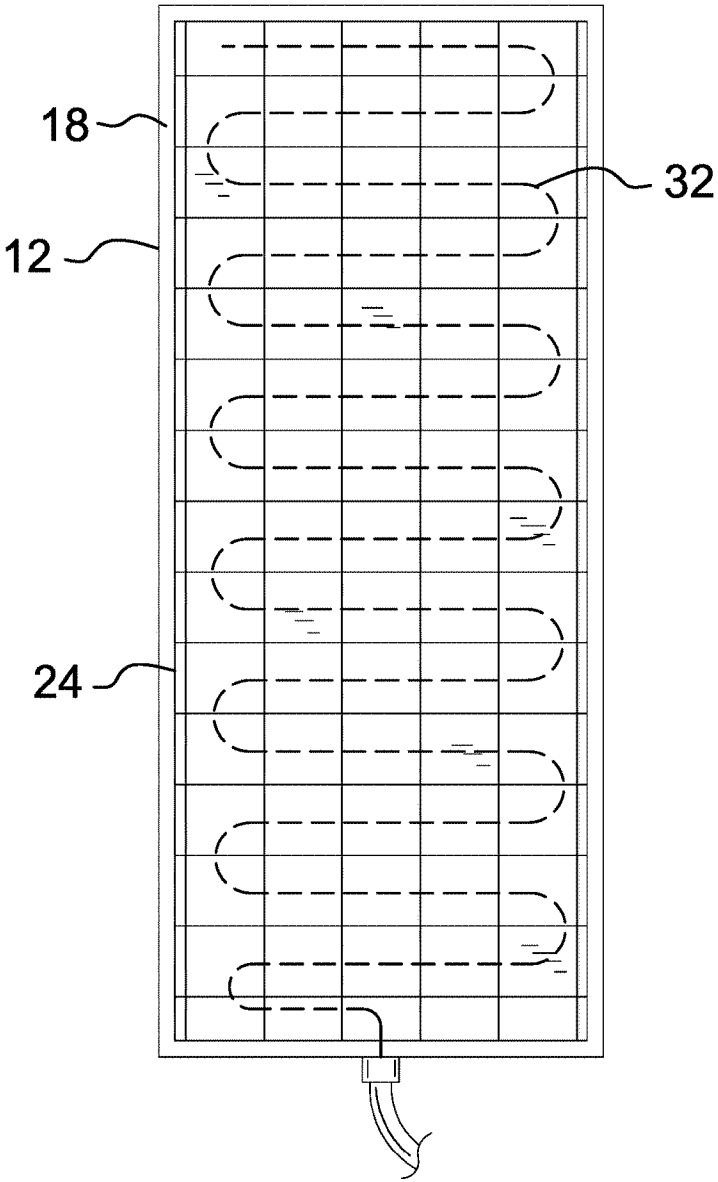
FIG. 5 is a top phantom view of a panel of an embodiment of the disclosure.

With reference now to the drawings, and in particular to FIGS. 1 through 5 thereof, a new sizing device embodying the principles and concepts of an embodiment of the disclosure and generally designated by the reference numeral 10 will be described.

As best illustrated in FIGS. 1 through 5, the shoe sizing assembly 10 generally comprises a panel 12 that is positionable on a support surface 14 for having a person's foot placed thereon. The panel 12 may be placed in a shoe store or other retail environment that sells shoes. The panel 12 has a lower side 16 and an upper side 18, and a plurality of feet 20 is each coupled to the lower side 16 of the panel 12 to abut the support surface 14. A control circuit 22 is coupled to the panel 12.

A scanner 24 is coupled to the panel 12 and the scanner 24 is electrically coupled to the control circuit 22. The scanner 24 emits a measuring signal upwardly from the panel 12 thereby facilitating the scanner 24 to detect the sole of person's foot. In this way the scanner 24 can measure the size of the person's foot. Moreover, the control circuit 22 calculates a shoe size based upon the measured size of the person's foot. The scanner 24 may be a thermal imaging scanner or any other type of electronic scanner that is capable of detecting and measuring the sole of the person's foot.

A display 26 is coupled to the panel 12 and the display 26 is electrically coupled to the control circuit 22. The display 26 displays sizing indicia comprising numbers and letters indicating the measured size of the person's foot. Additionally, the display 26 displays numbers and letters indicating the calculated shoe size to communicate the size of a shoe sole 28 and a shoe upper 30 that correspond to the calculated shoe size. The shoe store may have a plurality of shoe soles 28 and shoe uppers 30 in every shoe size. Thus, a store attendant can retrieve a shoe sole 28 and a shoe upper 30 that corresponds to the calculated shoe size. The shoe soles 28 and the shoe uppers 30 may be manufactured by Nike, Addidas and any other existing, commercial shoe manufacturer. Additionally, the shoe sole 28 and the shoe upper 30 may include adhesive that is common to the shoe construction industry.

A heating element 32 is coupled to the panel 12 and the heating element 32 is electrically coupled to the control circuit 22. The heating element 32 is in thermal communication with the panel 12 and the heating element 32 heats the panel 12 when the heating element 32 is turned on. In this way the heating element 32 can melt an adhesive between the shoe sole 28 and the shoe upper 30 for bonding the shoe sole 28 to the shoe upper 30. Thus, a shoe can be constructed that has a customized size that corresponds to the measured size of the person's foot. The heating element 32 may be an electric heating coil of the like that has an operational temperature sufficient to melt shoe adhesive. A power button 34 is coupled to the panel 12 and the power button 34 is electrically coupled to the control circuit 22 for turning the control circuit 22 on and off. The heating element 32 may have an on/off button.

A lid 36 is positionable on the panel 12 when the heating element 32 is turned on. The lid 36 has a top wall 38 and an outer wall 40 extending downwardly therefrom, and the outer wall 40 has a distal edge 42 with respect to the top wall 38. The distal edge 42 abuts the upper side 18 of the panel 12 having the lid 36 completely covering the panel 12 when the lid 36 is positioned on the panel 12. The distal edge 42 has a cord slot 44 extending upwardly toward the top wall 38. Additionally, the top wall 38 has an outwardly facing surface 46 and the outwardly facing surface 46 has image indicia 48 thereon comprising an image of the sole of a human foot.

A power cord 50 is coupled to and extends away from the panel 12 and the power cord 50 is electrically coupled to the control circuit 22. The power cord 50 has a distal end 52 with respect to the panel 12 and a plug 54 is electrically coupled to the distal end 52. The plug 54 can be electrically coupled to a power source, such as a female electrical outlet or the like. Moreover, the cord slot 44 in the lid 36 accommodates the power cord 50 when the lid 36 is positioned on the panel 12.

In use, the person places one of their feet onto the upper side 18 of the panel 12 so the scanner 24 can scan and thusly measure the sole of the person's foot. The control circuit 22 calculates the size of shoe that corresponds to the measurement of the person's foot and the display 26 displays the measurements. Thus, the store attendant can retrieve a corresponding shoe sole 28 and shoe upper 30 and subsequently place the shoe sole 28 and shoe upper 30 in an assembled position on the panel 12. The lid 36 is placed on the panel 12 and the heating element 32 is actuated to heat the panel 12. Thus, the shoe sole 28 is bonded to the shoe upper 30 thereby producing a shoe that is customized to the measurement of the person's foot. In this way each of the person's feet 20 can have a customized shoe thereby enhancing the quality of fit of the shoe.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shoe sizing assembly being configured to measure a person's foot and subsequently bond a shoe sole to a shoe upper for a customized shoe size for each of a persons' feet, said assembly comprising:

a panel being positionable on a support surface wherein said panel is configured to have a person's foot placed thereon;

a control circuit being coupled to said panel;

a scanner being coupled to said panel, said scanner being electrically coupled to said control circuit, said scanner emitting a measuring signal upwardly from said panel thereby facilitating said scanner to detect the sole of person's foot wherein said scanner is configured to measure the size of the person's foot; and a heating element being coupled to said panel, said heating element being in thermal communication with said panel, said heating element being electrically coupled to said control circuit, said heating element heating said panel when said heating element is turned on wherein said heating element is configured to melt an adhesive between the shoe sole and the shoe upper for bonding the shoe sole to the shoe upper.

2. The assembly according to claim 1, further comprising:

said panel having a lower side and an upper side;

said scanner being positioned on said upper side of said panel; and a plurality of feet, each of said feet being coupled to said lower side of said panel wherein each of said feet is configured to abut the support surface.

3. The assembly according to claim 2, further comprising:

said control circuit calculating a shoe size based upon the measured size of the person's foot; and a display being coupled to said panel, said display being electrically coupled to said control circuit, said display displaying sizing indicia comprising numbers and letters indicating the measured size of the person's foot and numbers and letters indicating the calculated shoe size wherein said display is configured to communicate the size of a shoe sole and a shoe upper that correspond to the calculated shoe size.

4. The assembly according to claim 2, further comprising:

a lid being positionable on said panel when said heating element is turned on, said lid having a top wall and an outer wall extending downwardly therefrom, said outer wall having a distal edge with respect to said top wall, said distal edge abutting said upper side of said panel having said lid completely covering said panel;

said distal edge having a cord slot extending upwardly toward said top wall; and said top wall having an outwardly facing surface, said outwardly facing surface having image indicia thereon comprising an image of the sole of a human foot.

5. The assembly according to claim 4, further comprising a power cord being coupled to and extending away from said panel, said power cord being electrically coupled to said control circuit, said power cord having a distal end with respect to said panel, said distal end having a plug being electrically coupled thereto, said plug being configured to be electrically coupled to a power source, said cord slot in said lid accommodating said power cord when said lid is positioned on said panel.

6. A shoe sizing assembly being configured to measure a person's foot and subsequently bond a shoe sole to a shoe upper for a customized shoe size for each of a persons' feet, said assembly comprising:

a panel being positionable on a support surface wherein said panel is configured to have a person's foot placed thereon, said panel having a lower side and an upper side;

a plurality of feet, each of said feet being coupled to said lower side of said panel wherein each of said feet is configured to abut the support surface;

a control circuit being coupled to said panel;

a scanner being coupled to said panel, said scanner being electrically coupled to said control circuit, said scanner emitting a measuring signal upwardly from said panel thereby facilitating said scanner to detect the sole of person's foot wherein said scanner is configured to measure the size of the person's foot, said control circuit calculating a shoe size based upon the measured size of the person's foot;

a display being coupled to said panel, said display being electrically coupled to said control circuit, said display displaying sizing indicia comprising numbers and letters indicating the measured size of the person's foot and numbers and letters indicating the calculated shoe size wherein said display is configured to communicate the size of a shoe sole and a shoe upper that correspond to the calculated shoe size;

a heating element being coupled to said panel, said heating element being in thermal communication with said panel, said heating element being electrically coupled to said control circuit, said heating element heating said panel when said heating element is turned on wherein said heating element is configured to melt an adhesive between the shoe sole and the shoe upper for bonding the shoe sole to the shoe upper;

a power button being coupled to said panel, said power button being electrically coupled to said control circuit for turning said control circuit on and off;

a lid being positionable on said panel when said heating element is turned on, said lid having a top wall and an outer wall extending downwardly therefrom, said outer wall having a distal edge with respect to said top wall, said distal edge abutting said upper side of said panel having said lid completely covering said panel, said distal edge having a cord slot extending upwardly toward said top wall, said top wall having an outwardly facing surface, said outwardly facing surface having image indicia thereon comprising an image of the sole of a human foot; and a power cord being coupled to and extending away from said panel, said power cord being electrically coupled to said control circuit, said power cord having a distal end with respect to said panel, said distal end having a plug being electrically coupled thereto, said plug being configured to be electrically coupled to a power source, said cord slot in said lid accommodating said power cord when said lid is positioned on said panel.

* * * * *